US007114742B1

(12) United States Patent
Sterns

(10) Patent No.: US 7,114,742 B1
(45) Date of Patent: Oct. 3, 2006

(54) CREEPER APPARATUS FOR USE ON ROUGH UNEVEN TERRAIN

(76) Inventor: Frank J. Sterns, 507 W. Briarbrook La., Carl Junction, MO (US) 64834

( * ) Notice: Subject to any disclaimer, the term of this patent is extended or adjusted under 35 U.S.C. 154(b) by 121 days.

(21) Appl. No.: 10/973,316

(22) Filed: Oct. 27, 2004

(51) Int. Cl.
*B25H 5/00* (2006.01)

(52) U.S. Cl. ..... 280/639; 280/79.2; 280/79.7; 280/35; 280/32.6; 280/640

(58) Field of Classification Search ..... 280/32.6, 280/32.5, 640, 639, 35, 79.2, 79.7
See application file for complete search history.

(56) References Cited

U.S. PATENT DOCUMENTS

| | | | | |
|---|---|---|---|---|
| 716,735 | A | 12/1902 | Mitchell et al. | |
| 1,349,941 | A * | 8/1920 | Broome | 280/32.6 |
| 1,745,562 | A | 2/1930 | Taicher | |
| 1,823,526 | A | 9/1931 | Breeden | |
| 2,564,323 | A * | 8/1951 | Brown | 5/640 |
| 2,818,266 | A | 12/1957 | Cabler | |
| 3,137,511 | A * | 6/1964 | Weil et al. | 280/5.24 |
| 4,185,846 | A | 1/1980 | Black | |
| 4,395,186 | A | 7/1983 | Whyte | |
| 4,792,147 | A | 12/1988 | Wissing | |
| 4,875,694 | A | 10/1989 | Hamrick | |
| D356,412 | S | 3/1995 | Hensley, Jr. | |
| 5,397,139 | A * | 3/1995 | Simpson | 280/32.6 |
| 5,577,744 | A * | 11/1996 | Parks | 280/32.6 |
| D406,433 | S | 3/1999 | Taylor et al. | |
| D406,684 | S | 3/1999 | Pool et al. | |
| 6,357,063 | B1 * | 3/2002 | Selby | 5/81.1 R |
| 6,578,859 | B1 | 6/2003 | Chen | |
| 7,032,907 | B1 * | 4/2006 | Marsh | 280/32.6 |

* cited by examiner

*Primary Examiner*—Christopher P. Ellis
*Assistant Examiner*—Cynthia F. Collado
(74) *Attorney, Agent, or Firm*—Donald R. Schoonover

(57) ABSTRACT

A creeper apparatus for use on rough uneven terrain includes body means having an anterior portion and a posterior portion, wherein the anterior portion and the posterior portion are spaced in an angular relationship at a juncture between the anterior and posterior portions; axle means fixedly connected to the body means in close proximity to the juncture between the anterior and posterior portions, the axle means having a first end and a second end extending transversely outwardly from the body means; wheel means including a pair of opposing wide tread resilient wheels, one rotatable mounted on each of the first and second ends of the axle means; and stabilizing means connected to the posterior portion of the body means.

10 Claims, 1 Drawing Sheet

CREEPER APPARATUS FOR USE ON ROUGH UNEVEN TERRAIN

BACKGROUND OF THE INVENTION

1. Field of the Invention

The present invention relates to accessories for vehicles and more specifically, without limitation, to accessories for repairing and maintaining vehicles.

2. Description of the Related Art

Vehicles are essential to almost every aspect of everyday life. From time to time, those vehicles require various types of repair or maintenance. Some of the vehicle components requiring such repair or maintenance is readily accessible. Other components may require the use of jacks or hydraulic lifts to elevate the vehicle in order to provide access to the underside of the vehicle.

A commonly available implement for obtaining limited access to the underside of a vehicle is a platform supported on four swivel-mounted wheels, commonly referred to as a creeper. The wheels of such creepers are rigid and have a relatively small diameter so the platform is spaced in close proximity to the underlying floor to thereby enable a user to maneuver a portion of his body under the vehicle while lying face up on the creeper. Unfortunately, due to the small diameter of the wheels, the use of such creepers is limited to areas having a relatively smooth hard surface, such as a concrete floor for example. As a result, such creepers cannot be used on soft surfaces or rough or uneven terrain because the weight of the user bearing down on the creeper causes the wheels to be submerged in the soft underlying surface or unable to surpass even relatively small obstacles.

A not unusual situation is for an off-road vehicle to need repair or maintenance at a location remote from a smooth hard surface floor or a hydraulic lift, wherein work is needed on the underneath side of the vehicle. Since it would be fruitless to transport a prior art creeper to the site of the stranded vehicle because of its inability to operate in such terrain, about the only alternative would be to tow the vehicle to a hydraulic lift or to a smooth hard surface where a prior art creeper could be used.

What is needed is a creeper that can be easily used not only on hard surfaces but also on soft or rough or uneven terrain.

PRINCIPAL OBJECTS AND ADVANTAGES OF THE INVENTION

The principal objects and advantages of the present invention include: providing a creeper apparatus for use on soft or rough or uneven terrain; providing such an apparatus that includes relatively large, resilient, wide-tread wheels; providing such an apparatus that has a posterior portion that is substantially parallel to the underlying surface when not maneuvered into a usable position and an anterior portion that is substantially parallel to the underlying surface when maneuvered into a usable position; and generally providing such an apparatus that is reliable in performance, capable of long lasting life, and particularly well adapted for the proposed usages thereof.

Other objects and advantages of this invention will become apparent from the following description taken in conjunction with the accompanying drawings wherein are set forth, by way of illustration and example, certain embodiments of this invention.

SUMMARY OF THE INVENTION

The improvements of the creeper apparatus for use on rough uneven terrain include body means having an anterior portion and a posterior portion, wherein the anterior portion and the posterior portion are connected in an angular relationship at a juncture between the anterior and posterior portions; reinforcing means connected to the body means and structured to reinforce the angular relationship between the anterior portion and the posterior portion of the body means; offset axle means fixedly connected to the body means in close proximity to the juncture between the anterior and posterior portions, the axle means having a first end and a second end extending transversely outwardly from the body means; wheel means including a pair of opposing wide tread resilient wheels, one rotatable mounted on each of the first and second ends of the axle; maneuvering means connected to said body means; handle means connected to the anterior portion of the body means; stabilizing means connected to the posterior portion of the body means; headrest means connected to the handle means; and guard means connected to the body means, the guard means including a fender for each of the pair of opposing wheels, wherein each fender extends upwardly from the body means along an interior side, and over the top, of a respective one of the pair of opposing wheels. The first and second ends of the axle means are offset wherein a lower extremity of the body means is operatively suspended approximately one to one and one-half inches above an underlying surface.

DETAILED DESCRIPTION OF THE INVENTION

Figures 1, 2:
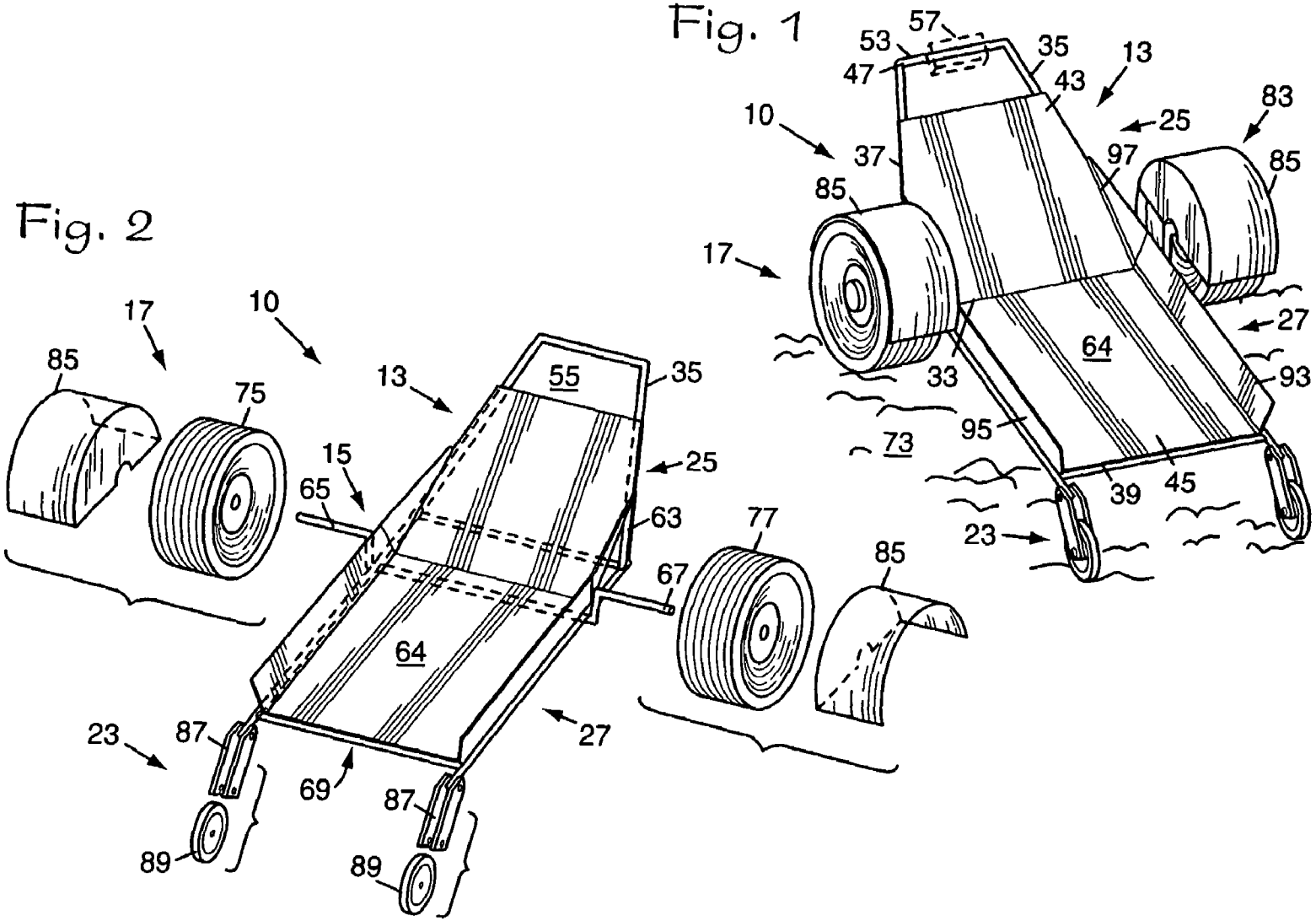
FIG. 1 is a perspective view of a creeper apparatus for rough uneven terrain in accordance with the present invention.
FIG. 2 is an exploded, perspective view of the creeper apparatus in accordance with the present invention.

As required, embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

The reference numeral 10 generally refers to a creeper apparatus for use on rough uneven terrain in accordance with the present invention, as shown in the FIGS. 1 and 2. The creeper apparatus 10 includes body means 13, axle means 15, wheel means 17, and stabilizing means 23.

The body means 13 includes an anterior portion 25 and a posterior portion 27. The anterior portion 25 and the posterior portion 27 are connected in an angular relationship at a juncture 33 between the anterior portion 25 and the posterior portion 27.

The body means 13 includes frame means 35, such as square- or cylindrically-shaped tubing, extending along a perimeter 37 of the anterior portion 25 and along a perimeter 39 of the posterior portion 27.

The body means 13 also includes an anterior platform 43 supported by and secured to the frame means 35 of the anterior portion 25. The body means 13 further includes an posterior platform 45 supported by and secured to the frame means 35 of the posterior portion 27. The anterior platform 43 may be connected to the posterior platform 45 at the juncture 33. Alternatively, the anterior platform 43 may be spaced apart from the posterior platform 45 leaving a gap therebetween, if desired.

The creeper apparatus 10 may include a handle means 47, such as, for example, by extending a crossbar 53 of the frame means 35 beyond the anterior platform 43 leaving an opening 55 between the crossbar 53 and the anterior platform 43, for gripping purposes to manually maneuver the creeper apparatus 10 into position as needed. It is to be understood that other handle arrangements could be utilized to accomplish the same purpose.

If desired, the creeper apparatus 10 may also include a resilient headrest mounted on the anterior portion 43, or on the handle means 47 as indicated by the broken lines designated by numeral 47, to operatively support a user's head during a use of the creeper apparatus 10.

The anterior portion 25 is dimensioned such that the anterior portion 25 typically extends beneath and operatively supports the upper torso, including the shoulders and head, of a user. The posterior portion 27 is dimensioned such that the posterior portion 27 typically extends beneath and supports the lower torso, including the buttocks, legs and feet, of a user. Generally, the buttocks of the user is placed in close proximity to the juncture 33. The width of the body means 13 is dimensioned to comfortably accommodate the body of a user lying face up thereon. For example, a planar region 64 of the posterior portion 27 of the creeper apparatus 10 may have a width of approximately sixteen inches.

The weight of the anterior portion 25 relative to the weight of the posterior portion 27 is distributed such that when the creeper apparatus 10 is not being used, the creeper apparatus 10 rests on and is self-supported by the wheel means 17 and the stabilizing means 23 with the posterior portion 27 spaced substantially parallel to an underlying supporting surface and with the anterior portion 25 angled upwardly relative to the underlying supporting surface.

The creeper apparatus 10 may include reinforcing means 63 fixedly secured to the body means 13, wherein the reinforcing means 63 is structured to reinforce the angular relationship between the anterior portion 25 and the posterior portion 27 of the body means 13.

The axle means 15 is fixedly connected to the body means 13 in close proximity to the juncture 33 between the anterior portion 25 and the posterior portion 27. The axle means 15 includes a first end 65 and a second end 67, each extending transversely and opposingly outwardly from the body means 13. The first and second ends 65, 67 of the axle means 15 are offset upwardly such that a lower extremity 69 of the posterior portion 27 of the body means 13 is operatively suspended approximately one to one and one-half inches above the underlying surface 73.

The wheel means 17 includes a pair of opposing resilient wheels 75, 77 constructed of resilient material. The pair of wheels 75, 77 may be inflatable, balloon, hollow, solid, or other suitable structure. One of the pair of wheels 75, 77 is rotatable mounted on the first 65 of the axle means 15, and the other is rotatable mounted on the second end 67 of the axle means 15. The pair of wheels 75, 77 have wide treads and are dimensioned to provide ease of maneuverability over rough uneven terrain including obstacles such as gravel, etc. For example, the wheels 75, 77 may have a diameter of approximately ten inches.

The creeper apparatus 10 may also include guard means 83 connected to the body means 13, wherein the guard means 83 includes a fender 85 for each of the pair of opposing wheels 75, 77. Preferably, each fender 85 extends upwardly from the body means 13 along an interior side, and over the top, of a respective one of the pair of opposing wheels 75, 77.

The stabilizing means 23 generally includes at least one stabilizer 87 mounted on, and extending outwardly from, the posterior portion 27 of the body means 13. The at least one stabilizer 87 curves downwardly such that when the pair of wheels 75, 77 and the at least one stabilizer 87 are in contact with the underlying surface 73, the posterior portion 27 of the creeper apparatus 10 is substantially parallel with the underlying surface 73. The lower extremity 69 of the at least one stabilizer 87 that contacts the underlying surface 73 may be a rotatably mounted roller 89, a skid or runner, or other suitable arrangement, that prevents the lower extremity 69 from operatively submerging into the underlying surface 73. Preferably, the at least one stabilizer 87 includes two stabilizers 87.

The creeper apparatus 10 may also comprise maneuvering means 93, including an element 95 fixedly attached to and extending generally upwardly from each side of the posterior portion 27. For example, the elements 95 may extend upwardly approximately two and one-half inches from the planar region 64 of the posterior portion 27 of the creeper apparatus 10. If desired, elements 95 may extend to and be combined with the reinforcing means 63 by including the portion designated by numeral 97. Alternatively, the posterior portion 27 may have a downwardly cupped configuration in order to provide the maneuvering means 93.

In an application of the present invention, the handle means 47 is used to roll the creeper apparatus 10 over the ground on the pair of opposing wheels 75, 77 to a location beside the stranded vehicle with the anterior portion 25 in close proximity to and directed toward the portion of the vehicle that needs attention. A user then lies down, face up on the creeper apparatus 10 with his buttocks positioned on the posterior portion 27 of the body means 13. This provides a distribution of the user's weight such that the pair of opposing wheels 75, 77 and the at least one stabilizer 87 bear against the underlying surface 73 with the posterior portion 27 being spaced generally parallel to the underlying surface 73 and the anterior portion 25 angled upwardly relative to the underlying surface 73.

While still lying on the creeper apparatus 10, the user then places one or both of his legs over the side or sides of the creeper apparatus 10. The maneuvering means 93 is sufficiently narrow such that the undersides of the user's legs easily clear the maneuvering means 93, with the maneuvering means 93 still having sufficient width to perform its intended purpose as described below.

To maneuver the creeper apparatus 10, the user presses downwardly with one or both of his heels, lifting the at least one stabilizer 87 clear of the underlying surface 73 such that the anterior portion 25 is substantially parallel with the underlying surface 73 and the posterior portion 27 is angled upwardly from the underlying surface 73 and such that the creeper apparatus 10, with the user lying thereon, is supported only by the pair of opposing wheels 75, 77 and not by the at least one stabilizer 87. The user then creates forward or rearward forces between the contact of one or both of his heels with the underlying surface 73, or between one heel against the underlying surface 73 and the user's other leg on the posterior portion 27 and bearing against the maneuvering means 93 to create appropriate moments to orient and steer the creeper apparatus 10 into position for accessing the underside of the vehicle. The pair of large, resilient wide-tread wheels 75, 77 enable the user to maneuver and steer the creeper apparatus 10, even over uneven rough terrain, while continuing to lie thereon.

By so operatively orienting the creeper apparatus 10 such that the anterior portion 25 is substantially parallel to the underlying surface 73, the spacing of the anterior portion 25 above the underlying surface 73 approximates the spacing of a prior art creeper above a smooth level hard surface but with the creeper apparatus 10 supported on only two wide tread, relatively large diameter resilient wheels 75,77 mounted at one end of the anterior portion 25, not narrow tread, relatively small diameter wheels mounted near each of the four corners of prior art creepers.

In other words, the creeper apparatus 10 of the present invention provides repair and maintenance capabilities at least equivalent to those provided by prior art creepers, but, instead of being limited to use on only smooth hard surfaces, is readily usable on soft, rough and uneven terrain. The fact that the posterior portion 27 of the creeper apparatus 10 is operatively angled upwardly relative to the underlying surface 73 is not a hindrance because in substantially all, if not all, situations requiring the use of a creeper, only the upper torso of a user needs to be positioned under a vehicle for repair and maintenance purposes, not the lower torso.

It is to be understood that while certain forms of the present invention have been illustrated and described herein, it is not to be limited to the specific forms or arrangement of parts described and shown.

What is claimed is:

1. A creeper apparatus for use on rough uneven terrain, comprising:

(a) body means having an anterior portion and a posterior portion, wherein the anterior portion and the posterior portion are spaced in an angular relationship at a juncture between the anterior and posterior portions;

(b) axle means fixedly connected to the body means in close proximity to the juncture between the anterior and posterior portions, the axle means having a first end and a second end extending transversely outwardly from the body means;

(c) wheel means including a pair of opposing wide tread resilient wheels, one rotatable mounted on each of the first and second ends of the axle means; and (d) stabilizing means connected to the posterior portion of the body means; and (e) wherein, in use, the anterior portion is angularly displaced to a horizontal orientation such that the creeper apparatus is supported only by the pair of opposing wheels and is not supported by the stabilizing means as a user presses downwardly with one or both of his heels against an underlying surface.

2. The creeper apparatus as described in claim 1, further comprising guard means connected to the body means.

3. The creeper apparatus as described in claim 2, wherein the guard means includes a fender for each of the pair of opposing wheels.

4. The creeper apparatus as described in claim 3, wherein each fender extends upwardly from the body means along an interior side, and over the top, of a respective one of the pair of opposing wheels.

5. The creeper apparatus as described in claim 1, further comprising handle means on the anterior portion of the body means.

6. The creeper apparatus as described in claim 5, further comprising headrest means mounted on the handle means.

7. The creeper apparatus as described in claim 5, further comprising reinforcing means connected to the body means and structured to reinforce the angular relationship between the anterior portion and the posterior portion of the body means.

8. The creeper apparatus as described in claim 1, wherein the first and second ends of the axle means are offset wherein a lower extremity of the body means is operatively suspended approximately one to one and one-half inches above an underlying surface.

9. The creeper apparatus as described in claim 1, further comprising maneuvering means connected to the body means.

10. The creeper apparatus as described in claim 9, wherein the maneuvering means includes elements fixedly attached to and extending generally upwardly from each side of the posterior portion.

* * * * *